US005538671A

United States Patent [19]

Morrall

[11] Patent Number: 5,538,671

[45] Date of Patent: Jul. 23, 1996

[54] DETERGENT COMPOSITIONS WITH BUILDER SYSTEM COMPRISING ALUMINOSILICATES AND POLYASPARTATE

[75] Inventor: Stephen W. Morrall, Guilford, Ind.

[73] Assignee: The Procter & Gamble Company, Cincinnati, Ohio

[21] Appl. No.: 206,234

[22] Filed: Mar. 3, 1994

Related U.S. Application Data

[63] Continuation of Ser. No. 966,987, Oct. 27, 1992, abandoned.

[51] Int. Cl.[6] ..... C11D 3/33; C11D 3/12; C11D 3/37

[52] U.S. Cl. ..... 510/476; 510/532; 510/347; 510/352; 510/360; 510/507

[58] Field of Search ..... 252/174.25, 546, 252/544, 525, 527, 174.24, DIG. 2, 15

[56] References Cited

U.S. PATENT DOCUMENTS

| | | | |
|---|---|---|---|
| 282,329 | 12/1888 | Heinzman et al. . | |
| 756,094 | 9/1891 | Murch . | |
| 3,846,380 | 11/1974 | Fujimoto et al. | 260/78 A |
| 3,922,230 | 11/1975 | Lamberti et al. | 252/89 |
| 3,993,573 | 11/1976 | Glass | 252/135 |
| 4,062,647 | 12/1977 | Storm et al. | 8/137 |
| 4,072,621 | 2/1978 | Rose | 252/89 R |
| 4,379,080 | 5/1983 | Murphy | 252/526 |
| 4,428,749 | 1/1984 | Morris | 8/137 |
| 4,446,035 | 5/1984 | Barrat et al. | 252/8.8 |
| 4,490,271 | 12/1984 | Spadini et al. | 252/174.23 |
| 4,534,881 | 8/1985 | Sikesll et al. | 252/180 |
| 4,605,509 | 8/1986 | Corkill | 252/131 |
| 4,732,693 | 3/1988 | Hight | 252/132 |
| 4,770,815 | 9/1988 | Baker et al. | 252/542 |
| 4,959,409 | 9/1990 | Heinzman et al. | 525/61 |
| 5,019,292 | 5/1991 | Baeck et al. | 252/174.25 |
| 5,104,568 | 4/1992 | Shaw, Jr. et al. | 252/174.18 |
| 5,152,902 | 10/1992 | Koskan et al. | 210/698 |
| 5,219,986 | 6/1993 | Cassata | 530/324 |
| 5,266,237 | 11/1993 | Freeman et al. | 252/542 |
| 5,284,512 | 2/1994 | Koskan et al. | 106/416 |
| 5,328,631 | 7/1994 | Du Vosel et al. | 252/174.23 |
| 5,328,690 | 7/1994 | Sikes | 424/401 |
| 5,338,476 | 8/1994 | Pancheri et al. | 252/174.14 |

FOREIGN PATENT DOCUMENTS

| | | |
|---|---|---|
| 324595 | 1/1989 | European Pat. Off. . |
| 0454126 | 10/1991 | European Pat. Off. . |
| 454126 | 10/1991 | European Pat. Off. . |
| 0511037 | 10/1992 | European Pat. Off. . |
| 511037 | 10/1992 | European Pat. Off. . |
| 0612842 | 8/1994 | European Pat. Off. . |
| 2675153 | 10/1992 | France . |
| 1806502 | 5/1970 | Germany . |
| 3626672 | 2/1988 | Germany . |
| 3724460 | 2/1988 | Germany . |
| 1404814 | 9/1975 | United Kingdom . |
| 2160424 | 12/1985 | United Kingdom . |
| WO92/15535 | 9/1992 | WIPO . |

OTHER PUBLICATIONS

U.S. Pct 92/08050 Willey et al. Sep. 21, 1992.

*Primary Examiner*—Paul Lieberman
*Assistant Examiner*—Ardith Hertzog
*Attorney, Agent, or Firm*—K. W. Zerby; J. J. Yetter; J. C. Rasser

[57] ABSTRACT

Soil removal performance of granular laundry detergents containing aluminosilicate builders is improved by presence of polyaspartic acid (or its water-soluble salts) as a co-builder/soil dispersant.

2 Claims, No Drawings

DETERGENT COMPOSITIONS WITH BUILDER SYSTEM COMPRISING ALUMINOSILICATES AND POLYASPARTATE

This is a continuation of application Ser. No. 07/966,987, filed on Oct. 27, 1992, now abandoned.

TECHNICAL FIELD

The present invention relates to improvements in the detergency performance of laundry detergent compositions which utilize zeolites as a sequestering agent for water hardness.

BACKGROUND ART

U.S. Pat. No. 4,605,509, Corkill et al., issued Aug. 12, 1986 discloses that certain aluminosilicate ion exchange materials are useful as water hardness sequestrants (builders) for use in laundry detergent compositions.

U.S. Pat. No. 4,072,621, Rose, issued Feb. 7, 1978 discloses the addition of a water-soluble copolymer of a vinyl compound and maleic anhydride to granular detergents containing aluminosilicate builders. The polymer provides improved granule physical properties, particularly relating to reduced dustiness, and improved cleaning performance, especially in the presence of ortho and pyrophosphate which are formed by hydrolysis of tripolyphosphates in the spray drying of detergents.

U.S. Pat. No. 4,490,271, Spadini et al., issued Dec. 25, 1984 discloses the use of a mixture of polyethylene glycol/polyacrylate to improve the clay soil removal performance of detergents based on non-phosphate builders such as crystalline or amorphous aluminosilicates.

U.S. Pat. No. 4,379,080, Murphy, issued Apr. 5, 1983 discloses the use of film-forming polymers in granular detergents containing crystalline or amorphous aluminosilicate builders and less than 10% phosphate builders. The polymers facilitate quick dissolution of the granules. The film-forming polymers include polymers and copolymers made from unsaturated mono- or polycarboxylic acids such as acrylic and, hydroxyacrylic acid, methacrylic acid, etc.

U.S. Pat. No. 4,534,881, Sikes et al., issued Aug. 13, 1985, discloses the use of polyamino acids such as polyaspartic acid in aqueous systems as agents to prevent formation and deposition of $CaCO_3$ onto surfaces in contact with said systems.

U.S. Pat. No. 4,732,693 Hight, issued Mar. 22, 1988 describes soap based detergent compositions which also comprise a nonionic surfactant and a cellulose ether. The compositions contain less than 10% phosphate builder. Optionally other builders such as carbonates, silicates and aluminosilicates can also be present. Various polymers can also optionally be present as anti-deposition agents. These include polyacrylates, copolymers of maleic anhydride with ethylene, acrylic acid, vinyl methylether, allyl acetate or styrene. Polyaspartic acid is also disclosed.

SUMMARY OF THE INVENTION

The present invention encompasses granular detergent compositions comprising:

(a) from about 5% to about 40% by weight of an organic surfactant selected from the group consisting of anionic, nonionic, zwitterionic, ampholytic and cationic surfactants, and mixtures thereof;

(b) from about 5% to about 40% of a finely divided aluminosilicate ion exchange material selected from the group consisting of:

(1) crystalline aluminosilicate material of the empirical formula:

$$Na_z[(AlO_2)_z \cdot (SiO_2)y] \cdot xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg. $CaCO_3$ eq./g. and a calcium ion exchange rate of at least about 2 grains $Ca^{++}$/gallon/minute/gram/gallon;

(2) amorphous hydrated aluminosilicate material of the empirical formula:

$$M_z(zAlO_2 \cdot ySiO_2)$$

wherein M is sodium, potassium, ammonium, or substituted ammonium, z is from about 0.5 to about 2 and y is 1, said material having a magnesium ion exchange capacity of at least about 50 milligram equivalents of $CaCO_3$ hardness per gram of anhydrous aluminosilicate and a $Mg^{++}$ exchange rate of at least about 1 grain/gallon/minute/gram/gallon; and (3) mixtures thereof;

(c) from about 5% to about 75% by weight of a water-soluble neutral or alkaline salt; and (d) from about 1% to about 30% of polyaspartic acid or water-soluble salts thereof.

wherein the ratio of (b) to (d) is from about 20:1 to about 1:10.

DETAILED DESCRIPTION OF THE INVENTION

In accordance with the present invention, it has been found that polyaspartic acid and its salts act as effective co-builders/soil dispersants for aluminosilicate ion exchange materials in detergent compositions. It has been found that, especially for particulate inorganic soils such as clay, the soil removal performance of detergent compositions containing the combination exceeds that which would be predicted based upon that which is achieved in comparable compositions containing either material alone. A further desirable characteristic of the polyaspartates is that they are biodegradable.

The granular detergent compositions of the present invention contain, as essential components, a detergent surfactant, an aluminosilicate ion exchange material, a polyaspartate builder and a water-soluble neutral or alkaline salt as described hereinafter. The compositions contain less than about 10%, preferably less than about 5%, by weight of phosphate materials Most preferably, the compositions are substantially free of phosphate materials.

All percentages, parts and ratios used herein are by weight unless otherwise specified.

A. Detergent Surfactant

The compositions of the present invention comprise from about 5% to about 40% of a detergent surfactant selected from the group consisting of anionics, nonionics, zwitterionics, ampholytics, cationics, and mixtures thereof. Preferably the surfactant represents from about 5 to 30%, most preferably from about 10 to 25%, by weight of the composition and is selected from the group consisting of anionics, nonionics, and mixtures thereof.

Water-soluble salts of the higher fatty acids, i.e., "soaps," are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$–$C_{18}$ carbon atoms) such as those produced by reducing the glycerides to tallow or coconut oil; and the sodium and potassium alkylbenzene sulfonates in which the alkyl group contains from about 10 to about 16 carbon atoms, in straight chain or branched chain configuration, i.e., see U.S. Pat. Nos. 2,220,099 and 2,477,383. Especially valuable are linear straight chain alkylbenzene sulfonates in which the average number of carbon atoms in the alkyl group is from about 11 to 14, abbreviated $C_{11-14}$ LAS.

Especially preferred are mixtures of $C_{10-16}$ (preferably $C_{11-13}$) linear alkylbenzene sulfonates and $C_{12-18}$ (preferably $C_{14-16}$) alkyl sulfates. These re preferably present in a weight ratio of between 4:1 and 1:4, preferably about 3:1 to 1:3, alkylbenzene sulfonate:alkyl sulfate. Sodium salts of the above are preferred.

Other anionic surfactants herein are the sodium alkyl glyceryl ether sulfonates, especially those ethers of higher alcohol s derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the instant detergent granules. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 80 moles of ethylene oxide per mole of alkyl phenol.

Included are the water-soluble and water-dispersible condensation products of aliphatic alcohols containing from 8 to 22 carbon atoms, in either straight chain or branched configuration, with from 3 to 12 moles of ethylene oxide per mole of alcohol.

Other types of nonionic surfactants useful herein are polyhydroxy fatty acid amides of the formula

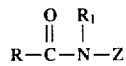

wherein R is $C_9$–$C_{17}$ alkyl or alkenyl, $R_1$ is methyl and Z is glycityl derived from a reduced sugar or alkoxylated derivative thereof. Examples are N-Methyl N-1-deoxyglucityl cocoamide and N-Methyl N-1-deoxyglucityl oleamide. Processes for making polyhydroxy fatty acid amides are known, e.g., see U.S. Pat. No. 2,965,576, Wilson, issued Dec. 20, 1960 and U.S. Pat. No. 2,703,798, Schwartz, issued Mar. 8, 1955.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80.

Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent granules. Cationic surfactants comprise a wide variety of compounds characterized by one or more organic hydrophobic group sin the cation and generally by a quaternary nitrogen associated with an acid radical. Pentavalent nitrogen ring compounds are also considered quaternary nitrogen compounds. Halides, methyl sulfate and hydroxide are suitable balancing anions for soil compounds. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr., et al., issued Feb. 3, 1976, which is incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

Further disclosures of surfactants are set forth in U.S. Pat. No. 3,644,961, Norris, issued May 23, 1972; U.S. Pat. No. 3,919,678, Laughlin et al., issued Dec. 30, 1975; and U.S. Pat. No. 4,379,080, Murphy, issued Apr. 5, 1983, all incorporated in their entirety herein by reference.

ALUMINOSILICATE ION EXCHANGE MATERIAL

The detergent compositions herein also contain from about 5% to about 40%, preferably from about 10% to about 30% by weight of finely divided (i.e., 10 microns or less in diameter) particulate aluminosilicate ion exchange material which can be crystalline or amorphous. The crystalline aluminosilicates herein have the formula $$Na_z[(AlO_2)_z\cdot(SiO_2)y]\cdot xH_2O$$

wherein z and y are at least about 6, the molar ratio of z to y is from about 1.0 to about 0.5 and x is from about 10 to about 264.

Amorphous hydrated aluminosilicate materials useful herein have the empirical formula $$M_z(zAlO_2\cdot ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight of crystalline aluminosilicate, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_3$/g. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite B, and Zeolite X, an especially preferred crystalline aluminosilicate ion exchange material has the formula $$Na_{12}[AlO_2)_{12}(SiO_2)_{12}]\cdot xH_2O$$

wherein x is from about 20 to about 30, especially about 27.

WATER-SOLUBLE NEUTRAL OR ALKALINE SALTS

The granular detergents of the present invention additionally contain from about 5% to about 70%, preferably from about 10% to about 60%, and more preferably from about 20% to about 50%, by weight of a water-soluble neutral or alkaline salt. The neutral or alkaline salt has a pH in solution of seven or greater, and can be either organic or inorganic in nature. The salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt herein.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, polyhydroxysulfonates, polyacetates, carboxylates, and polycarboxylates. Preferred are the alkali metal, especially sodium, salts of the above. Preferably, the present compositions contain less than about 10%, preferably less than about 5%, by weight of phosphate materials. Most preferably, the compositions are substantially free of phosphates.

Examples of non-phosphorus, inorganic builders are sodium and potassium carbonate, bicarbonate, sesqui-carbonate, tetraborate decahydrate, and silicate having a molar ratio of $SiO_2$ to alkali metal oxide of from about 0.5 to about 4.0, preferably from about 1.0 to about 2.4.

Water-soluble, non-phosphorus organic builders useful herein include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylene diamine tetraacetic acid.

Further disclosure of non-phosphorous builders can be found in U.S. Pat. No. 3,308,067 Diehl, issued Mar. 7, 1967, U.S. Pat. No. 4,144,226, Crutchfield, et al., issued Mar. 13, 1979, and U.S. Pat. No. 4,246,495 Crutchfield, et al., issued Mar. 27, 1979, all incorporated in their entirety herein by reference.

POLYASPARTIC ACID

The polyaspartic acid (including water soluble salts thereof) which is an essential component of the compositions herein can be described by the following formula:

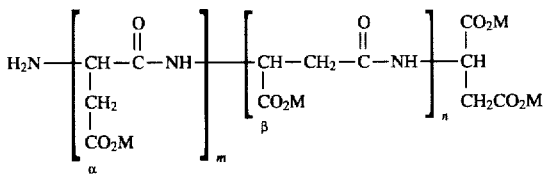

wherein m+ n is from about 5 to about 85, preferably from about 16 to about 42, the ratio of α/β is from 1/0 to 0/1 (typically 1/4 to 4/1 in most cases about 1/3), and wherein M is hydrogen or a neutralizing cation such as alkali metal (e.g., sodium or potassium), ammonium or substituted ammonium (e.g., mono-, di-, or triethanolammonium). The α and β blocks in the above formula can vary in number of repeating units and can be randomly distributed along the chain. The absolute configuration about the assymetric carbon atoms can be d or 1.

The molecular weight of the polyaspartates herein (based on the acid form) can be from about 700 to about 10,000, and is preferably in the range of from about 2,000 to about 5,000.

Polyaspartic acid can be prepared by known methods. Preparation by the reaction of maleic acid and ammonia is described in U.S. Pat. No. 4,839,461, Boehmke, issued Jun. 13, 1989, incorporated herein by reference. Other methods are described in Seta et al., J.A.C.S. 75:6530 (1953), Idelson, et al., J.A.C.S. 80:4631 (1958), Sandek et al., Biopolymers, 20:1615 (1981) also incorporated herein by reference.

An especially simple and preferred method is described in U.S. Pat. No. 5,057,597, Koskan, issued Oct. 15, 1991, incorporated by reference herein. According to this method, an agitated fluid bed of freely flowing, solid particulate aspartic is formed, then heated to and maintained at 180° C. to 250° C. for a time sufficient to polymerize the acid and drive off water, while at the same time maintaining a mean particle size of about 150 microns or less and providing a degree of agitation sufficient to maintain the particles in a substantially free-flowing state. The product of this heating process is the anhydropolyaspartic acid, which is then recovered from the fluidized bed and hydrolyzed to a polyaspartate salt with aqueous base (e.g., aqueous sodium hydroxide). This process typically produces polyaspartate salts having (on an acid basis) a molecular weight of from about 1,600 to about 3,600, i.e., m+n in the above formula is from about 13 to about 30. If desired, the hydrolysis of anhydropolyaspartic acid can be conducted in acid media to produce polyaspartic acid.

The ratio of aluminosilicate to polyaspartate in the composition should be in the range of from about 20:1 to about 1:10. Further desirable ranges are 15:1 to 1:10, 10:1 to 1:10 and 5:1 to 1:5.

OPTIONAL INGREDIENTS

Other ingredients commonly used in detergent compositions can be included in the compositions of the present invention to impart their known performance benefits or other known characteristics. These include color speckles, bleaching agents and bleach activators, suds boosters or suds suppressors, anti-tarnish and anti-corrosion agents, soil suspending agents, soil release agents, dyes, fillers, optical brighteners, germicides, pH adjusting agents, non-builder alkalinity sources, hydrotropes, enzymes, e.g., lipases, proteases, cellulases, amylases and mixtures thereof, enzyme-stabilizing agents, processing aids and perfumes.

A preferred optional ingredient is a crystalline layered sodium silicate builder material having the formula $NaMSI_xO_{2x}+1 \cdot yH_2O$ in which M denotes sodium or hydrogen, x is 1.9 to 4 and y is 0 to 20. These substantially water insoluble materials are described in U.S. Pat. No. 4,664,839, Rieck, issued May 12, 1987, incorporated herein by reference. In the above formula, M preferably represents sodium. Preferred values for x are 2, 3 or 4. Compounds having the composition $NaMSi_2O_5 \cdot yH_2O$ are particularly preferred. The crystalline layered silicates preferably have an average particle size of from about 0.1 micron to 10 microns. Examples of preferred materials are Na-SKS-6 and Na-SKS-7, both commercially available from Hoechst A.G.

Another preferred optional ingredient is citric acid.

PREPARATION OF COMPOSITIONS

The compositions here in are prepared by drying an aqueous slurry comprising the above components. The slurry generally contains from about 25% to about 50% water, whereas the dried granules contain from about 3% to about 15% water. The drying operation can be accomplished by any convenient means, for example, by using spray-drying towers, both counter-current and co-current, fluid beds, flash-drying equipment, or industrial microwave or oven drying equipment. Processes involving agglomerating the components of the composition can also be used. If desired, the anhydropolyaspartic acid (also called polysuccinimide) can be added to an alkaline slurry of the other detergent components before drying or agglomerating. In the concentrated aqueous alkaline medium, the anhydropolyaspartic acid will be converted to the aspartate salt.

The following example is illustrative of the present invention, but is not intended to be in any way limiting thereof.

EXAMPLE

The following detergent composition of the invention is prepared by spray drying all components together except the polyaspartate, which is then added to the dried granules.

| | |
|---|---|
| Na Linear $C_{14-15}$ alkylbenzene sulfonate | 14.5% |
| $NaC_{14-15}$ alkyl sulfate | 6.2 |
| Na silicate | 2.9 |
| Na aluminosilicate (Zeolite A-Ethyl Corp.) | 28.8 |
| Na carbonate | 23.4 |
| Na sulfate | 12.3 |
| Optical brightener | .1 |
| DC 544 (silicone process aid) | .1 |
| Na polyaspartate (M.W. 3200) | 3.4 |
| Moisture | 8.4 |

The composition has excellent soil removal performance in the laundering of fabrics, especially in the removal of clay soils.

What is claimed is:

1. A detergent composition comprising:

(a) from about 5% to about 40% by weight of an organic surfactant selected from the group consisting of anionic, nonionic, zwitterionic, ampholytic and cationic surfactants, and mixtures thereof;

(b) from about 5% to about 40% of a finely divided aluminosilicate ion exchange material selected from the group consisting of:

(1) crystalline hydrated aluminosilicate material of the empirical formula:

$$Na_z \cdot xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg. $CaCO_3$ eq./g. and a calcium ion exchange rate of at least about 2 grains $Ca^{++}$/gallon/minute/gram/gallon;

(2) amorphous hydrated aluminosilicate material of the empirical formula:

$$M_z(zAlO_2 \cdot ySiO_2)$$

wherein M is sodium, potassium, ammonium, or substituted ammonium, z is from about 0.5 to about 2 and y is 1, said material having a magnesium ion exchange capacity of at least about 50 milligram equivalents of $CaCO_3$ hardness per gram of anhydrous aluminosilicate and a $Mg^{++}$ exchange rate of at least about 1 grain/gallon/minute/gram/gallon; and (3) mixtures thereof;

(c) from about 1% to 3.4% by weight of a polyaminocarboxylate selected from the group consisting of polyaspartic acid and water soluble salts thereof.

2. The composition according to claim 1 wherein the component (c) is the water soluble salt of polyaspartic acid, and the molecular weight of said salt, on an acid basis, is from about 2,000 to about 5,000.

* * * * *